US009927159B2

(12) United States Patent
Waibel et al.

(10) Patent No.: US 9,927,159 B2
(45) Date of Patent: Mar. 27, 2018

(54) METHOD FOR OPERATING A SYSTEM FOR A THERMODYNAMIC CYCLE WITH A MULTI-FLOW EVAPORATOR, CONTROL UNIT FOR A SYSTEM, SYSTEM FOR A THERMODYNAMIC CYCLE WITH A MULTI-FLOW EVAPORATOR, AND ARRANGEMENT OF AN INTERNAL COMBUSTION ENGINE AND A SYSTEM

(71) Applicant: MTU Friedrichshafen GmbH, Friedrichshafen (DE)

(72) Inventors: Niklas Waibel, Friedrichshafen (DE); Daniel Stecher, Pfullendorf (DE); Gerald Fast, Markdorf (DE); Tim Horbach, Friedrichshafen (DE); Jens Niemeyer, Friedrichshafen (DE); Max Lorenz, Friedrichshafen (DE); Mathias Müller, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 368 days.

(21) Appl. No.: 14/673,187

(22) Filed: Mar. 30, 2015

(65) Prior Publication Data

US 2015/0276283 A1 Oct. 1, 2015

(30) Foreign Application Priority Data

Mar. 31, 2014 (DE) ..... 10 2014 206 043

(51) Int. Cl.

| | |
|---|---|
| ***F25D 3/12*** | (2006.01) |
| ***F25B 41/04*** | (2006.01) |
| ***F25B 39/02*** | (2006.01) |
| ***F22B 29/06*** | (2006.01) |
| ***F22B 35/10*** | (2006.01) |

(52) U.S. Cl.

CPC ..... *F25B 39/028* (2013.01); *F22B 29/06* (2013.01); *F22B 35/10* (2013.01)

(58) Field of Classification Search

CPC ..... F22B 29/06; F22B 35/10; F22B 39/028
USPC ..... 62/56, 216
See application file for complete search history.

(56) References Cited

U.S. PATENT DOCUMENTS

| | | | | |
|---|---|---|---|---|
| 5,398,644 | A * | 3/1995 | Nilsson | F22B 35/10 122/406.4 |
| 5,644,929 | A | 7/1997 | Tanaka et al. | |
| 6,199,401 | B1 | 3/2001 | Haussmann | |
| 6,957,630 | B1 * | 10/2005 | Mastronarde | F22B 1/1815 122/406.4 |
| 2004/0149239 | A1 * | 8/2004 | Franke | F02C 6/18 122/406.4 |

(Continued)

FOREIGN PATENT DOCUMENTS

| | | | |
|---|---|---|---|
| DE | 19719251 | A1 | 11/1998 |
| DE | 102011003649 | A1 | 8/2012 |

*Primary Examiner* — Henry Crenshaw
(74) *Attorney, Agent, or Firm* — Lucas & Mercanti, LLP; Klaus P. Stoffel

(57) ABSTRACT

A method for operating a system for a thermodynamic cycle with a multi-flow evaporator having at least two evaporator flow channels, wherein the evaporator flow channels are made to approximate each other with respect to at least one operating parameter of the individual evaporator flow channels, and/or wherein a pressure drop across the evaporator is automatically controlled.

11 Claims, 2 Drawing Sheets

(56) References Cited

U.S. PATENT DOCUMENTS

| | | | | |
|---|---|---|---|---|
| 2005/0257753 | A1* | 11/2005 | Franke | F22B 1/1815 122/406.4 |
| 2006/0081359 | A1* | 4/2006 | Franke | F22B 1/1815 165/104.11 |
| 2007/0092380 | A1* | 4/2007 | Fulkerson | B05B 7/1454 417/65 |
| 2007/0246106 | A1* | 10/2007 | Tonkovich | B01F 3/0807 137/561 A |
| 2009/0255245 | A1* | 10/2009 | Wu | F15B 1/021 60/327 |
| 2010/0095688 | A1 | 4/2010 | Taras et al. | |
| 2010/0186935 | A1* | 7/2010 | Wand | F25B 39/04 165/173 |
| 2011/0239961 | A1* | 10/2011 | Bauver, II | F22B 1/18 122/7 R |
| 2011/0259042 | A1 | 10/2011 | Nishino et al. | |
| 2013/0180474 | A1* | 7/2013 | Wilhelm | F28F 9/013 122/406.4 |
| 2014/0027096 | A1 | 1/2014 | Freund et al. | |
| 2014/0060683 | A1* | 3/2014 | Bathina | F02C 7/22 137/597 |
| 2014/0144136 | A1* | 5/2014 | Versteyhe | F02G 5/02 60/605.1 |

* cited by examiner

METHOD FOR OPERATING A SYSTEM FOR A THERMODYNAMIC CYCLE WITH A MULTI-FLOW EVAPORATOR, CONTROL UNIT FOR A SYSTEM, SYSTEM FOR A THERMODYNAMIC CYCLE WITH A MULTI-FLOW EVAPORATOR, AND ARRANGEMENT OF AN INTERNAL COMBUSTION ENGINE AND A SYSTEM

CROSS-REFERENCE TO RELATED APPLICATIONS

The present application claims priority of DE 10 2014 206 043.5, filed Mar. 31, 2014, the priority of this application is hereby claimed and this application is incorporated herein by reference.

BACKGROUND OF THE INVENTION

The invention pertains to a method for operating a system for a thermodynamic cycle, to a control unit for a system for a thermodynamic cycle, to a system for a thermodynamic cycle, and to an arrangement consisting of an internal combustion engine and a corresponding system.

Systems of the type in question here and methods for operating them are known. A system of this type usually comprises a circuit, through which a working medium is conveyed by a feed pump. This medium is vaporized in a evaporator and sent to an expansion device, in which it is expanded. Some of the heat absorbed by the working medium in the evaporator in converted to mechanical work. After the expansion, the working medium is cooled, in particular condensed, in a condenser, after which it is sent back to the feed pump again. A typical cycle for a system like this is the Clausius-Rankine cycle. A modification of this is the organic Rankine cycle, in which an organic working medium is typically used, which can be vaporized at a lower temperature level than water. Thus the organic Rankine cycle is especially suitable for making use of waste heat in industry, for using the waste heat of internal combustion engines, or for use in geothermal power generating plants, for example. Systems are known in which the evaporator has multiple flow channels. This can serve the purpose, for example, of making it possible to include several heat sources into the cycle; in addition, a multi-flow configuration of a single, integral evaporator can be advantageous for manufacturing reasons. When several evaporator flow channels of this type are operated in parallel, however, there is the problem of increased susceptibility to thermodynamic instabilities. In particular, the so-called Ledinegg instability can occur: When vaporization begins prematurely in one of the evaporator flow channels, the pressure drop in this channel increases sharply. This results in turn in a sharp decrease in the flow of medium through this evaporator flow channel as a result of the pressure relationships, and this causes the effect to become even more pronounced. The heat transfer in the evaporator is sharply reduced, because the evaporator flow channel in question is almost completely blocked. Thus the efficiency and the power output of the system decrease. There is also the danger that the working medium in the blocked flow channel can become unallowably superheated. In this case, deposits can also form, which permanently reduce the heat transfer in the evaporator and thus reduce the energy yield of the overall system over the long term. When working medium suddenly starts to flow through the blocked evaporator flow channel again, thermal shock can occur, leading to irreversible damage at least to the evaporator flow channel in question, if not to the entire evaporator.

SUMMARY OF THE INVENTION

The invention is therefore based on the goal of creating a method for operating a system for a thermodynamic cycle, wherein the system, in spite of comprising a multi-flow evaporator, shows a reduced tendency to develop thermodynamic instabilities, the method thus making it possible to operate the system in a stable and reliable manner. The invention is also based on the goal of creating a control unit for a system, a system for a thermodynamic cycle, and an arrangement consisting of an internal combustion engine and such a system, wherein a reduced tendency to develop thermodynamic instabilities is also achieved and reliable operation is guaranteed along with a high power yield.

The goal is achieved in a method in which a system for a thermodynamic cycle with a multi-flow evaporator is operated, wherein the evaporator comprises at least two evaporator flow channels. According to a first embodiment of the method, the individual evaporator flow channels are made approximately the same as each other with respect to at least one operating parameter of the individual evaporator flow channels. In particular, the vapor flow channels are made equal to each other with respect to the at least one operating parameter. This prevents the various evaporator flow channels from developing operating states which deviate too greatly from each other, as a result of which the risk of an instability developing in one of the evaporator flow channels, in particular the risk of a Ledinegg instability, is simultaneously minimized.

Alternatively, according to a second embodiment of the method, a pressure drop across the evaporator is automatically controlled. In this way, it is possible to ensure at all times and for every operating point of the system that at least the minimum pressure difference or minimum pressure drop across the evaporator necessary for the reliable operation of the system is present. It has been found that, the greater the total pressure drop across the evaporator, the more stable the system. Nevertheless, the minimum total pressure drop to be ensured depends on an operating point of the system, especially on the superheating of the working medium downstream from the evaporator. It has been observed that the greater the superheating of the working medium, that is, the farther away the system is operating from the saturated steam curve of the working medium, the lesser the tendency of the system to develop instabilities. Therefore, the greater the degree to which the working medium is superheated at the evaporator outlet or downstream from the evaporator, the smaller the minimum total pressure drop to be preset can be. It has also been found in general that, the greater the total pressure drop, the less important the role of the differences in the pressure drop across the individual evaporator flow channels, so that to this extent simply increasing the pressure drop across the evaporator increases the stability. Overall, therefore, by means of suitable automatic control of the pressure drop across the evaporator, the tendency of the system to develop instabilities, especially the Ledinegg instability, can be reduced. As previously suggested, the pressure drop is preferably automatically adjusted to match a suitable nominal pressure drop as a function of an operating point of the system.

The pressure drop across the evaporator overall is also referred to here and in the following as the "total pressure drop". This is to be distinguished from the pressure drop across an individual evaporator flow channel, which can differ from the total pressure drop as a result of fluctuations in the individual evaporator flow channel.

In a third embodiment of the method both the evaporator flow channels are made approximately the same as each other, especially made equal to each other, with respect to at least one operating parameter of the individual evaporator flow channels and the pressure drop across the evaporator is automatically controlled. In this way, the tendency of the system to develop instabilities, especially the Ledinegg instability, can be reduced in an especially efficient manner, and reliable operation with a high power yield can be guaranteed. A higher-level feedback control circuit is preferably provided to control the overall pressure drop, wherein, by means of lower-level control, the evaporator flows can be made to approximate each other or to be equal to each other.

In another embodiment of the method the evaporator flow channels are made approximately the same as each other with respect to the flow rate of the working medium. In particular, the evaporator flow channels are made equal to each other with respect to the flow rate. Here the term "flow rate" is intended to mean the mass flow rate of the working medium through the evaporator flow channels. This preferably ensures that each of the evaporator flow channels always contributes equally to the total mass flow rate of the working medium in the system. The total mass flow rate is preferably preset by a conveying device, especially by the output of the conveying device, which is preferably configured as a feed pump. In that the flow rates in the individual evaporator flow channels are approximately the same as, or equal to, each other, it is ensured that none of the evaporator flow channels will become unstable and that in particular none of them will become completely blocked. At the same time, it is ensured that each evaporator flow channel takes up approximately the same amount of heat in the evaporator. As a result, it is impossible for an individual evaporator flow channel to become superheated. In this embodiment of the method, therefore, the flow rate of the working medium in the individual evaporator flow channels is used as an operating parameter with respect to which the evaporator flow channels are made approximately the same.

Alternatively or in addition, the individual evaporator flow channels are made approximately the same as, or equal to, each other with respect to the temperature of the working medium downstream from the vaporization area of the individual evaporator flow channels. The temperature of the working medium in the area of an outlet from the evaporator flow channels is preferably used for this purpose. It has been found that the corresponding temperature is characteristic of the heat absorbed in the individual evaporator flow channel, wherein equalizing these temperatures guarantees an equalization of the thermodynamic state of the working medium in the flow channels and thus ultimately also an equalization of the mass flow rate through the individual evaporator flow channels. Within the scope of the method, the use of a temperature of the working medium as the operating parameter of the individual evaporator flow channels is advantageous in the sense that temperature sensors are always provided in any case the area of the outlets from the evaporator flow channels to monitor the system, so that there is no need for any additional, expensive sensor equipment and in particular no need for any additional flow sensors. Nevertheless, this approach is possible only when the system is operated with superheating of the working medium, because otherwise the temperatures downstream of the vaporization area in the evaporator flow channels are determined by the pressure prevailing there. As long as the unequal distribution between the evaporator flow channels is not too pronounced, wherein an individual flow channel is not being operated within the two-phase region, there will then be no deviations in the temperatures of the individual flow channels.

In contrast, approximating the evaporator flow channels to each other with respect to the flow rate of the working medium can be applied both during operation of the system with superheated working medium and during operation of the system the wet steam region. In addition, the approximation with respect to flow rates measured by flow sensors can be more accurate and thus more stable than the relatively indirect approximation on the basis of the temperature of the working medium.

Another embodiment of the method is characterized in that the pressure drop across the evaporator is automatically controlled by the actuation of control elements, wherein the control elements are assigned to the individual evaporator flow channels. Such control elements are typically provided in any case so that the flow cross sections of the individual evaporator flow channels can be varied independently of each other. To this extent there is no need for any special components to regulate the pressure drop.

In another embodiment of the method the control elements are configured as valves. In particular, it is possible to use standard valves, so that the flow cross sections of the individual evaporator flow channels can be easily adjusted in a simple and low-cost manner—preferably independently of each other.

An exemplary embodiment of the invention is characterized that the evaporator flow channels are made to approximate each other in that the control variables for the control elements are varied, wherein the control elements are assigned to the individual evaporator flow channels and limit the flow through the those channels. The control elements are preferably configured as valves. To this extent, these control elements are the same as the previously mentioned control elements used preferably to regulate the pressure drop across the evaporator. The control variables specify the functional position of the various control elements, so that ultimately the flow rate in the individual evaporator flow channels can be determined by setting these control variables. It is possible for the control variables to be varied as a function of the flow rate of working medium in the individual flow channels and/or as a function of a temperature of the working medium downstream from a vaporization area of the individual evaporator flow channels in order to make the evaporator flows equal to each other with respect to at least one of these operating parameters. The variation of the control variables acting on the control devices to vary the functional positions of the control elements leads to a system configuration which is both simple and also inexpensive and at the same time allows the method to be applied with great accuracy.

In another embodiment of the invention the control variables are renormalized in such a way that the control element upon which the control variable with the largest value is acting is opened to the maximum extent. A control variable is obtained for each evaporator flow channel from an approximation algorithm or a rule for equalizing the various evaporator flow channels, wherein one of these various control variables will happen to be the largest. In the normal case, this value will not be the largest possible value of the control variable, i.e., the value corresponding to the maximum opening of the control element. If the control variables determined in this way were transmitted without change to the control elements, the total extent to which these elements would be opened would be smaller than necessary for the equalization. This would lead to a greater pressure drop across the evaporator and thus a lower power yield of the system, especially because the conveying device must perform more work to convey the preset mass flow rate through the evaporator. Within the scope of the renormalization, the largest determined value of the control variables is now taken as the largest possible value, i.e., the value which corresponds to the maximum opening of the control element. The other, smaller control variables are scaled in linear fashion in correspondence with the change in the largest value. Thus, the individual values of the control variables have the same ratios to each other before the renormalization as they do after it, as a result of which the evaporator flow channels continue to be approximately the same as or equal to each other. The equalization now takes place, however, at a lower pressure drop across the evaporator, because all of the control elements are opened more widely than they would be would be without the renormalization. Accordingly, the overall efficiency of the system and its power output are increased, especially because now the conveying device does not need to work as hard to convey the same preset mass flow rate through the evaporator.

Within the scope of the method, control elements with linear a characteristic are preferably used, especially valves with a linear valve characteristic. As a result, the previously described renormalization can be carried out especially easily, wherein a simple, linear scaling of the various control variables guarantees constant ratios of the various flow cross sections set by the control elements.

In another embodiment the method is characterized in that the control variables are changed as a result of the automatic control of the pressure drop. The pressure drop control therefore acts preferably on the control variables calculated as part of the process of making the evaporator flow channels approximately the same as each other and changes the values of these variables to regulate the pressure drop. In particular, the control of the pressure drop limits the control variables. Such limitation occurs especially preferably in cases where the control variables are renormalized before they are transmitted to the control elements. This means that one of the control elements is always opened to the maximum as the evaporator flow channels are being made to approximate each other. It is thus no longer possible, within the scope of the pressure drop control, to lower the pressure drop across the evaporator, because any further opening of the control elements is no longer possible without changing the ratios of the flow cross sections in the individual evaporator flow channels. One of the control elements, namely, the one which is open to the maximum, can no longer be opened any further, as a result of which a kind of saturation of the equalization behavior is reached. As part of the process of controlling the pressure drop, however, the pressure drop control can limit the pressure drop across the evaporator by limiting, in particular by reducing, the control variables for the individual control elements. This only apparently represents a restriction: As previously described, it is important for the reliable operation of the system that a minimum pressure drop across the evaporator be maintained, the value of which typically depends on at least one operating parameter of the system, hence on an operating point of the system. Therefore, within the scope of the pressure drop control, there is no need to reduce the pressure drop, but there is a need for a possibility of increasing it by limiting the control variables and thus throttling the control elements down somewhat. Especially by limiting the various control variables by the same differential value or by throttling the various control elements by the same amount, the ratios of the values to each other—assuming linear characteristics—are not disturbed or changed, and thus the equalization of the various evaporator flow channels is not disturbed or changed either.

In a further embodiment of the method the nominal flow rate of the working medium in the individual evaporator flow channels is calculated by dividing the overall mass flow rate the system by the number of evaporator flow channels. This guarantees the equalization of the flow channels, wherein each individual evaporator flow channel is sent, as the nominal value, the same proportion of the overall mass flow rate of the working medium as all the other channels. The total mass flow rate is preferably set by the conveying device, especially the output of the conveying device, preferably by the rotational speed of the feed pump. It is possible to use a default value for the total mass flow rate of the conveying device. Alternatively, it is possible to detect the output of the conveying device and on that basis to determine, especially to calculate, a total mass flow rate in the system. It is especially preferable, however, to provide a flow sensor, preferably in the form of a measurement turbine, downstream from the conveying device, this sensor being set up and configured in such a way that it can be used to detect the total mass flow rate in the system. In any case, the total mass flow rate, divided by the number of evaporator flow channels, is preferably used to determine the nominal value for each evaporator flow channel, which value will then to this extent be identical for each of the evaporator flows channels.

In an additional embodiment of the method a nominal temperature of the working medium downstream from the vaporization area of the individual evaporator flow channel is calculated as an average value of the various temperatures of the working medium downstream from the vaporization areas of the individual evaporator flow channels, or this value is measured separately as the average temperature of the working medium downstream from the evaporator flow channels. It is also possible to measure the temperature of the working medium in each evaporator flow channel downstream from the vaporization area, especially in the area of the outlet from the flow channel. From the various temperature measurements of the individual evaporator flow channels, a mean value is calculated, which is then used as the nominal temperature within the scope of the method. The individual evaporator flow channels are made to be approximately the same as, or equal to, this nominal temperature. Alternatively, an average temperature of the working medium is measured downstream from the evaporator flow channels, preferably downstream from the point where the various evaporator flows are recombined, and used as a nominal value within the scope of the method. It is possible by either of these two approaches to make the thermodynamic state of the working medium the same in each of the individual evaporator flow channels. What this ultimately does is preferably again to equalize the flow rates in the various evaporator flow channels, which s important because this flow rate is an essential parameter which determines the superheating of the working medium in the evaporator flow channels.

Whereas adjusting a nominal flow rate in the individual evaporator flow channels makes especially accurate control possible and is also possible even during operation of the system in the wet steam region, adjusting the temperatures in the evaporator flow channels to a nominal temperature is especially easy and inexpensive to do, especially because there is no need for expensive flow sensors, which are preferably configured as measurement turbines.

In a further embodiment of the method a nominal pressure drop across the evaporator is read out from a characteristic diagram as a function of at least one operating parameter of the system. It has been found that the pressure drop across the evaporator to be maintained for the power yield and stability of the system depends on the evaporator's operating point. If the pressure drop is too small, system instabilities will occur, whereas, if the pressure crop is too large, the overall efficiency of the system and its power output are reduced, especially because the conveying device is forced to work against an unnecessarily large pressure drop in the evaporator. To this extent there exists for each operating point of the system an optimum nominal pressure drop, which is preferably stored in a characteristic diagram as a function of the operating point. The at least one operating parameter is preferably selected from a group consisting of a mass flow rate in the system, a temperature of the working medium downstream from the evaporator or at the outlet from the evaporator, and the superheating of the working medium downstream from the evaporator or from the evaporator outlet. It is especially preferable for the characteristic diagram to be generated on the basis of the mass flow rate of the working medium and the superheating of the medium. It then describes the minimum pressure differential across the evaporator to be specified and maintained in order to guarantee reliable operation of the system. Pressure fluctuations around the specified pressure drop occurring in the individual evaporator flow channels as a result of non-simultaneous transitions to the vapor state will thus be unlikely to lead to unstable system behavior. In particular, these pressure fluctuations are likely to be negligible as a percentage of the total pressure drop across the evaporator. The total pressure drop is then—as previously described—preferably set by throttling the individual control elements of the evaporator flow channels.

In an additional embodiment of the method the system is operated with the superheating of the working medium. In this case, the individual evaporator flow channels are made to be approximately the same as, preferably equal to, each other downstream from the vaporization region preferably with respect to a temperature of the working medium, wherein, in this way, the thermodynamic states of the working medium in the individual evaporator flow channels and ultimately also the flow rates in the evaporator flow channels can be made equal. There is no need for expensive flow sensors. If one of the evaporator flow channels is not carrying as much working medium as the other evaporator flow channels as a result of, for example, Ledinegg instability, the superheating of the working medium will be more pronounced in this channel. The superheating can therefore be used as a criterion for the throttling of the control elements. At a given pressure, equalizing the temperatures of the working medium has the immediate effect of also equalizing the various degrees of superheating downstream from the evaporator. It is also possible, however, to detect the pressure downstream from the evaporator and to use that to determine the degree of superheating. This pressure determines the position of the boiling point of the working medium in the evaporator and thus the superheating at a given temperature.

In another embodiment of the invention the system is operated in the wet steam region. The working medium is therefore not superheated in the evaporator; instead, saturated steam is produced in a mixture with liquid components of the working medium. The temperature in the evaporator and downstream from the evaporator depends then in a predetermined manner on the pressure downstream from the evaporator, so that the temperature cannot be used to equalize the various evaporator flow channels. In this case, therefore, it is preferable to equalize the flow rate in the individual evaporator flow channels. Operating the system in the wet steam region can nevertheless be efficient especially in conjunction with waste heat recovery, because under certain conditions it is possible to obtain a higher power yield from the system than when the system is operated under the superheating regime.

A further embodiment of the method is characterized in that an organic Rankine cycle (ORC process) is carried out in the system. The system is therefore preferably operated under ORC conditions. This cycle is especially adapted to stationary applications such as geothermal power generation plants or to waste heat recovery, especially in industrial plants or in conjunction with internal combustion engines.

The goal is also achieved in that a control unit for a system for operating a thermodynamic cycle is created. The control unit is set up to make the various evaporator flow channels approximately the same as each other with respect to at least one operating parameter of the individual evaporator flow channels and/or automatically to control a pressure drop across the evaporator. It is especially preferred that the control unit be set up to implement a method according to one of the previously described embodiments. Thus the advantages already explained on the basis of the method are realized for the control unit.

The control unit is set up to carry out such a method by permanently implementing it in an electronic structure, especially as a control unit in the form of hardware. As an alternative, a computer program product, which comprises instructions on the basis of which such a method can be performed when the computer program product runs on the control unit, is loaded into the control unit.

In another embodiment the control unit comprises an interface to at least one sensor for detecting an operating parameter of the individual evaporator flow channels, especially to flow sensors separately assigned to each of the evaporator flow channels and/or to temperature sensors separately assigned to each of the evaporator flow channels. Alternatively or in addition, the control unit preferably comprises an interface to a differential pressure sensor for detecting a pressure drop across the evaporator or and interface to two pressure sensors, the first of which is arranged upstream from the evaporator, the second downstream from the evaporator, wherein a pressure drop across the evaporator can be determined as the difference between the measurement values of the two sensors. The control unit preferably comprises an interface to control elements, one of which is assigned to each individual evaporator flow channel, so that it is possible to influence the flow cross section in each individual flow channel. The control unit preferably comprises an interface to a flow sensor arranged upstream from the point where the working medium is distributed over the individual evaporator flow channels and downstream from a conveying device for conveying the working medium around a circuit of the system. In this case, the control unit, with the help of the flow sensor, can detect a total mass flow rate of the working medium in the circuit. Alternatively or in addition, the control unit preferably comprises an interface to the conveying device to set and/or to detect its output, wherein in this way it is also possible to acquire information on the total mass flow rate in the system.

The goal is also achieved in that a system for a thermodynamic cycle, especially for operating a thermodynamic cycle, is created. The system comprises a multi-flow evaporator comprising at least two evaporator flow channels. Each evaporator flow channel has its own control element, which is arranged and set up to vary the flow cross section in the associated evaporator flow channel. In addition, the system comprises a control unit, especially a control unit according to one of the previously described exemplary embodiments, wherein the control unit is functionally connected to the control elements and is set up to make the evaporator flow channels approximately the same as each other with respect to at least one operating parameter by varying control variables for the control elements and/or automatically to regulate a pressure drop across the evaporator. In conjunction with the system, the advantages already explained in connection with the method and the control unit are realized.

A control element can be arranged in each evaporator flow channel upstream of a vaporization area of the evaporator flow channel. In particular, it is possible for the control element to be arranged in front of a evaporator inlet. The control elements are functionally connected to the control unit so that they can be controlled and especially so that the method can be implemented.

The system comprises a conveying device—seen in the flow direction of the working medium around a circuit—preferably configured as a feed pump; the evaporator; an expansion device; and a condenser. In addition, the system preferably comprises temperature sensors, one of which is assigned to each individual evaporator flow channel. Alternatively or in addition, a flow sensor is arranged in each evaporator flow channel. The various sensors are functionally connected to the control unit. The flow sensors are preferably arranged upstream of the control elements. The temperature sensors are preferably arranged downstream from the vaporization areas, especially downstream from the outlets of the individual channels leading out of the evaporator.

In another embodiment the system comprises a pressure differential sensor with a first measuring point upstream of the evaporator and upstream of the point where the working medium is distributed over the individual evaporator flow channels, and with a second measuring point downstream from the evaporator and preferably downstream from the point where the individual evaporator flow channels are recombined, to which sensor the control unit is also functionality connected so that the drop in pressure across the evaporator can be measured. Alternatively, it is possible to install a pressure sensor upstream of the evaporator and another one downstream from the evaporator at the previously explained measurement points, wherein the pressure drop can be calculated in the control unit as the difference between the measurement values supplied by the two pressure sensors, the control unit being functionally connected for this purpose to the two pressure sensors. The system preferably also comprises a temperature sensor downstream from the point where the evaporator flow channels are recombined downstream from the evaporator. This sensor makes it possible to measure an average temperature of the working medium after the individual flow channels have been recombined.

In a further embodiment the system also comprises a flow sensor upstream of the point where the evaporator flow is distributed over the individual evaporator flow channels and downstream from the conveying device, this sensor being functionality connected to the control unit to obtain the total mass flow rate in the system. The control unit is also preferably functionally connected to the conveying device to set and/or to detect the output of the conveying device.

The conveying device can be configured as a speed-regulated feed pump. In a preferred exemplary embodiment of the system, the expansion device is configured as a volumetrically operating expansion machine, especially as a reciprocating piston machine, as a rotary vane machine, as a Roots expander, or as a scroll expander. In an especially preferred exemplary embodiment, the expansion device is configured as a helical screw expander. It has been found that a helical screw expander comprises especially favorable properties and a high power yield precisely in combination with an ORC process. This is especially true when the system is operated in the wet steam region. The helical screw expander can also be used advantageously, however, when the system is operated with superheating of the working medium. Alternatively, it is also possible for the expansion device to be configured as a continuous-flow machine, especially as a turbine.

In an exemplary embodiment of the system, the expansion device—preferably by means of a shaft—is functionally connected to a generator, by means of which the mechanical work released in the expansion device can be converted into electrical energy. Alternatively or in addition, it is possible for the mechanical work released in the expansion device to be used as such to support an internal combustion engine, for example.

The system can be set up to carry out an organic Rankine cycle. This is especially adapted to the use of waste heat in stationary or mobile applications, especially for using waste heat in industrial processes or for using the waste heat of an internal combustion engine.

In another embodiment the system is set up to use the waste heat of an internal combustion engine. It is possible in this case for the system to use the waste heat contained in the exhaust gas of the internal combustion engine and/or the waste heat contained in a coolant of the internal combustion engine.

The goal is also achieved by an arrangement that comprises an internal combustion engine and a system according to one of the previously described exemplary embodiments, wherein the system is functionally connected to the internal combustion engine for the use of its waste heat. It is possible for exhaust gas of the internal combustion engine to be conducted to the evaporator of the system so that the waste heat contained in it can be used. Alternatively or in addition, it is possible for coolant of the internal combustion engine to be conducted to the evaporator of the system for the use of the waste heat contained in it. To this extent, there will be appropriate functional connections between the internal combustion engine and the evaporator of the system.

In one embodiment the arrangement is configured as a mobile arrangement, wherein the internal combustion engine serves especially preferably to drive a motor vehicle, in particular a heavy land vehicle, a rail vehicle, or even more preferably a water craft, in particular a ship, and quite especially a ferry. A stationary use of the arrangement is also possible, however, such as for stationary power generation, especially to cover an emergency power or peak power demand. The internal combustion engine of the arrangement is also adapted to drive stationary units such as pumps.

It is possible for the mechanical energy converted in the expansion device of the system to be sent directly to the internal combustion engine to support its operation, wherein it is transmitted directly to, for example, a crankshaft of the internal combustion engine. Alternatively or in addition, it is possible for the electrical energy generated by a generator functionally connected to the expansion device to be sent back to the crankshaft of the internal combustion engine by way of an electric motor. Alternatively or in addition, it is possible for the electrical energy generated by a generator functionally connected to the expansion device to be fed into a power supply system such as the on-board power supply of a motor vehicle equipped with the internal combustion engine or into a separate power supply system.

In all of these cases, the overall efficiency of the internal combustion engine can be increased by coordinating the system with it.

In another embodiment the internal combustion engine of the arrangement is configured as a reciprocating piston engine. In an exemplary embodiment, the internal combustion engine serves in particular to drive heavy land vehicles such as mining vehicles and trains or water craft, wherein the internal combustion engine is used in a locomotive or motor coach or in a ship. The use of the internal combustion engine to drive a vehicle serving defensive purposes such as a tank is also possible. In another exemplary embodiment of the internal combustion engine, it is stationary and used for stationary power generation to generate emergency power or to cover continuous-load or peak-load demands, wherein the internal combustion engine in this case preferably drives a generator. The stationary use of the internal combustion engine to drive auxiliary units such as fire-fighting pumps on offshore drilling rigs is also possible. An application of the internal combustion engine in the area of the recovery of fossil materials and especially fossil fuels such as oil and/or gas is also possible. The internal combustion engine can also be used in industry or in the construction field for the production of construction vehicles such as cranes and bulldozers. The internal combustion engine is preferably configured as a diesel engine; as a gasoline engine; or as a gas engine or operation with natural gas, biogas, customized gas, or some other suitable gas. Especially when the internal combustion engine is configured as a gas engine, it is suitable for use in block-type thermal power stations for stationary power generation.

The descriptions of the method on the one hand and of the control unit, the system, and the arrangement on the other hand are to be understood as complementary to each other. Features of the control unit, of the system, or of the arrangement which have been described explicitly or implicitly in conjunction with the method are preferably, individually or in combination with each other, features of a preferred exemplary embodiment of the control unit, of the system, or of the arrangement. Method steps which have been described explicitly or implicitly in conjunction with the control unit, the system, or the arrangement are preferably, individually or in combination with each other, steps of a preferred embodiment of the method. The method is characterized preferably by at least one method step which is required by at least one feature of the control unit, of the system, or of the arrangement. The control unit, the system, or the arrangement is preferably characterized by at least one feature which is required by at least one method step of the method.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
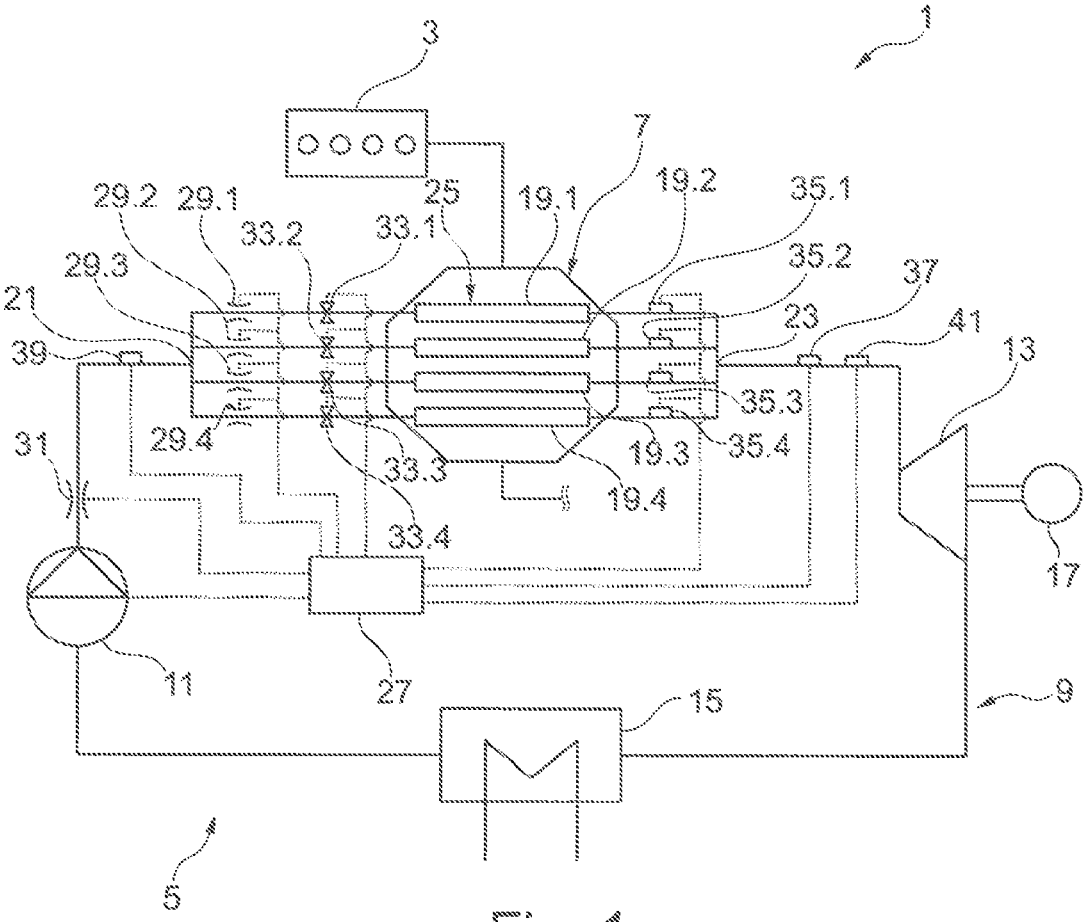
FIG. 1 shows a schematic diagram of an exemplary embodiment of an arrangement consisting of an internal combustion engine and a system.

FIG. 1 shows an arrangement 1 comprising an internal combustion engine 3 and a system 5 for a thermodynamic cycle. The system 5 and the internal combustion engine 3 are functionally connected to each other in such a way that waste heat of the internal combustion engine 3 is usable in the system 5, in that the waste heat of the internal combustion engine 3 is sent to a evaporator 7 of the system 5. This waste heat is preferably the waste heat from the exhaust gas of the internal combustion engine 3, which is sent to the evaporator 7. Alternatively or in addition, it is possible for waste heat from the coolant of the internal combustion engine 3 to be used the evaporator 7.

The system 5 comprises a circuit 9 for a working medium. The system 5 is preferably set up to carry out an ORC process, wherein ethanol is used especially preferably as the working medium.

In the direction in which the working medium flows around the circuit 9, a conveying device 11, the evaporator 7, an expansion device 13, and a condenser 15 are arranged, in that order. The expansion device 13, which is preferably configured as a helical screw expander, is functionally connected to a generator 17, so that mechanical work converted in the expansion device 13 can be converted into electrical energy by the generator 17.

As the working medium is being conveyed around the circuit 9 by the conveying device 11, it arrives first at the evaporator, where it takes up waste heat of the internal combustion engine 3, and wherein it is preferably vaporized. Then the working medium is expanded in the expansion device 13, wherein it performs mechanical work. Then the working medium is cooled back down, preferably condensed in the condenser 15, and sent back to the conveying device 11 again.

The evaporator 7 is of the multi-flow type. In the concrete exemplary embodiment shown here, it comprises four evaporator flow channels 19.1, 19.2, 19.3, 19.4. The working medium conveyed by the conveying device 11 is divided upstream of the evaporator 7 in a distributor 21 and distributed over the individual evaporator flow channels 19, which are recombined downstream of the evaporator 7 in a junction 23. A vaporization area 25 of the evaporator flow channels 19 is arranged in the evaporator 7.

The problem with a multi-flow evaporator of this type is that it tends to develop thermodynamic instabilities, especially the so-called Ledinegg instability. Vaporization begins prematurely in one of the flow channels 19, wherein the pressure drop across the flow channel 19 in question increases abruptly and sharply. As a result, the flow through this flow channel 19 decreases significantly, as a result of which the effect becomes even more pronounced. The heat transfer in the evaporator 7 thus becomes significantly reduced overall, because one of the channels is, in practice, completely blocked. This can lead to an unallowable superheating of the working medium in the blocked evaporator flow channel 19. This can in turn allow deposits to form, which permanently lower the heat transfer in the evaporator 7, as a result of which the energy yield of the overall system is reduced. When working medium suddenly starts to flow through blocked flow channel 19 again, it can cause thermal shock and thus lead to irreversible damage to the evaporator 7.

To reduce the tendency of the system 5 to develop thermodynamic instabilities, especially the Ledinegg instability, a control unit 27 is provided, which is configured to make the evaporator flow channels 19 approximately the same as each other with respect to at least one operating parameter, preferably to make them equal to each other with respect to the operating parameter, and/or automatically to control the pressure drop across the evaporator 7. In the case of the exemplary embodiment shown here, the control unit 27 is, in an especially preferred manner, set up both to make the evaporator flow channels 19 approximately the same with respect to at least one operating parameter and automatically to control the pressure drop across the evaporator 7.

It is preferably provided that the evaporator flow channels 19 are made approximately the same as each other with respect to the flow rate of the working medium. For this purpose, each of the evaporator flow channels 19 comprises a flow sensor 29.1, 29.2, 29.3, 29.4, wherein the flow sensors 29 are preferably arranged downstream of the distributor 21 and upstream of the evaporator 7. The system 5 also comprises a total flow sensor 31, which is provided downstream from the conveying device 11 and upstream of the distributor 21, so that, by means of the total flow sensor 31, a total mass flow rate in the circuit 9 can be determined. The control unit 27 is functionally connected both to the flow sensors 29 and to the total flow sensor 31. Alternatively or in addition, it is possible for the total mass flow rate to be calculatable in the control unit 27 from the output of the conveying device 11, or for the total mass flow rate to be preset by the control unit 27 and for the conveying device 11 to be actuated correspondingly with respect to its output. In any case, a nominal flow rate for the working medium through the individual evaporator flow channels 19 is preferably calculated by the control unit 27, in that the total mass flow rate is divided by the number of evaporator flow channels 19, that is, by four in the present case. The flow through the individual flow channels 19 is then adjusted automatically to match this nominal flow value.

A control element 33.1, 33.2, 33.3, 33.4, by means of which a flow cross section of the associated flow channel 19 can be changed, is arranged in each evaporator flow channel. The control elements 33 are preferably configured as valves. They are functionally connected to the control unit 27 and are actuated by it to make the evaporator flow channels 19 approximately the same as each other.

Alternatively or in addition to making the evaporator flow channels 19 equal to each other with respect to the flow of working medium, a measure for equalizing the temperatures of the working medium downstream of the vaporization area 25 is preferably provided. For this purpose, temperature sensors 35.1, 35.2, 35.3, 35.4 are arranged in the evaporator flow channels 19. These are preferably arranged downstream of the evaporator 7, i.e., of the vaporization area 25, and upstream of the junction 23. A nominal temperature for equalizing the evaporator flow channels 19 is calculated preferably as a mean value of the measurement values of the individual temperature sensors 35.1, 35.2, 35.3, 35.4. Alternatively, it is also possible, however, for an average temperature acquired by means of an overall temperature sensor 37 downstream from the junction 23 to be used as the nominal temperature. The temperature sensors 35 and/or the overall temperature sensor 37 are functionally connected to the control unit 27. Regardless of whether the evaporator flow channels 19 are equalized with respect to the flow rate or with respect to the temperature of the working medium, the control unit 27 acts in all cases on the control elements 33 to achieve the desired equalization.

So that the pressure drop across the evaporator 7 can be regulated, in the exemplary embodiment of the system 5 shown here, a first pressure sensor 39 is arranged upstream of the evaporator 7 and also upstream of the distributor 21, wherein a second pressure sensor 41 is arranged downstream from the evaporator 7 and also downstream from the junction 23. The pressure drop across the evaporator 7 can be calculated as the difference between the measurement value of the first pressure sensor 39 and the measurement value of the second pressure sensor 41. For this purpose, the pressure sensors 39, 41 are functionally connected to the control unit 27. This also acts on the control elements 33 to control the pressure drop automatically.

As an alternative, it is also possible to provide, instead of the pressure sensors 39, 41, a differential pressure sensor, which can measure a pressure difference directly. This differential pressure sensor is then preferably connected to a first measurement point at the site of the first pressure sensor 39 and to a second measuring point at the site of the second pressure sensor 41.

Figure 2:
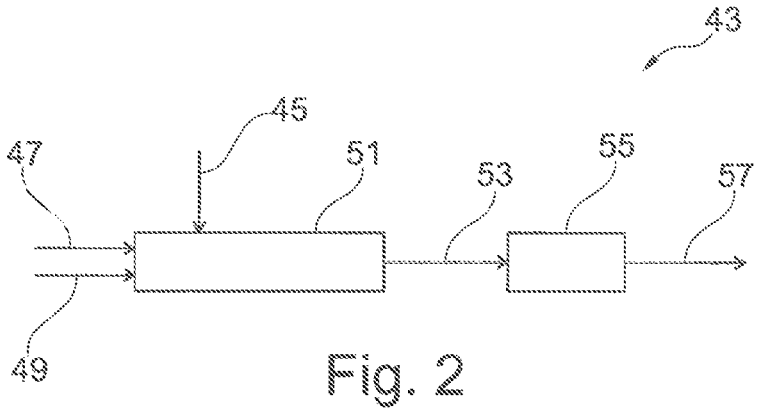
FIG. 2 shows a schematic diagram of a first detail of an embodiment of the method, namely, of automatic flow control for an individual evaporator flow channel.

FIG. 2 shows a schematic diagram of a detail of an embodiment of the method, in particular an automatic control member 43 for automatically controlling the flow through one of the evaporator flow channels 19.1, 19.2, 19.3, 19.4. A control member 43 of such a type is preferably provided for each of these evaporator flow channels 19, where it is sufficient to describe how it functions for one of the evaporator flow channels 19. A nominal value 45, which is either a nominal flow rate or a nominal temperature, is input into the control member 43. The nominal flow rate is preferably calculated as the total mass flow rate in the circuit 9 divided by the number of evaporator flow channels 19. The nominal temperature is preferably calculated as the average value of the measurement values of the temperature sensors 35.1, 35.2, 35.3, 35.4, or it is the measurement value of the overall temperature sensor 37. In addition, a corresponding actual value 47 is entered into the control element 43, this value being either an actual value for the flow rate in the evaporator flow channel 19.1, 19.2, 19.3, 19.4 being specifically considered or a temperature of the working medium in this channel 19.1, 19.2, 19.3, 19.4 downstream from the vaporization area 25, as measured by the temperature sensor 35.1, 35.2, 35.3, 35.4 assigned to the channel in question. In addition, an actual control variable 49 for the control element 33 assigned to the evaporator flow channel 19 specifically being considered is also input into the control member 43.

These input values are compared with each other in a calculation member 51 under consideration of a characteristic of the control element 33 in question, especially its characteristic curve, from which, as output, a differential control variable 53 is obtained. This is input into an automatic controller 55, which, finally, outputs a nominal control variable 57.

Figure 3:
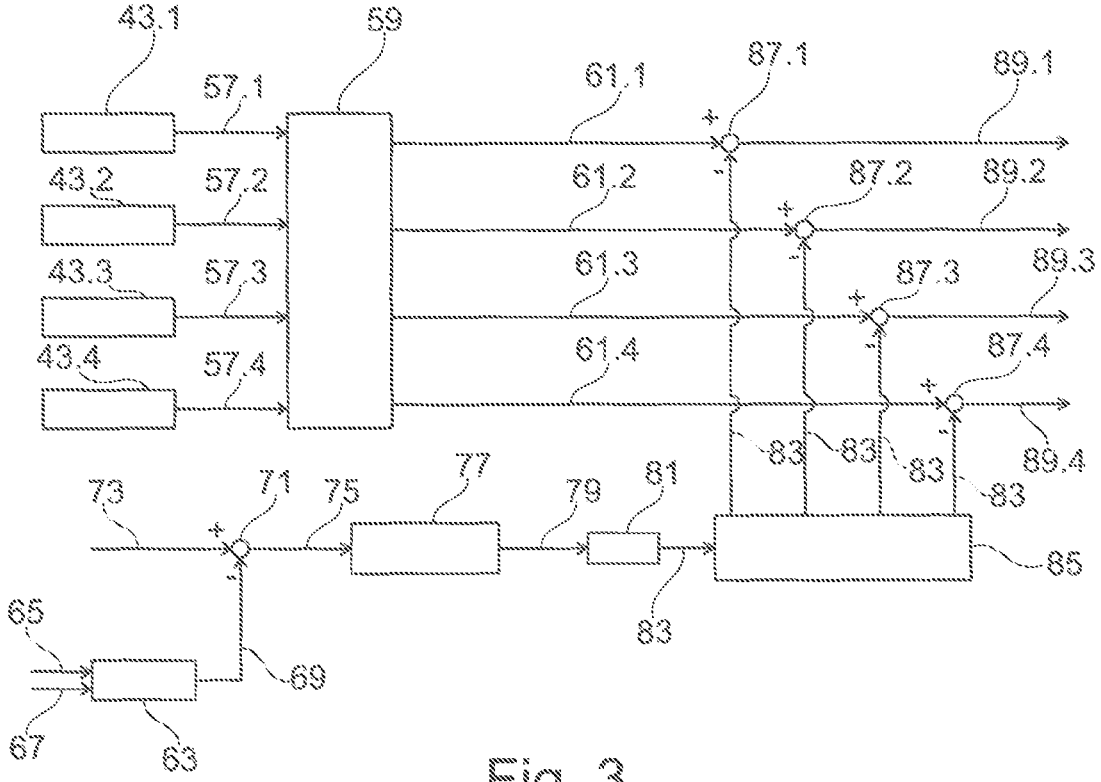
FIG. 3 shows a schematic diagram of a second detail of the embodiment of the method according to FIG. 2, namely, in particular an equalization of the evaporator flow channels and an automatic control of a pressure drop across the evaporator.

FIG. 3 shows a second detail of the embodiment of the method according to FIG. 2. Here the control members 43.1, 43.2, 43.3, 43.4 for the various evaporator flow channels 19 are shown, each of which is configured in the manner explained in conjunction with FIG. 2, and each of which outputs correspondingly a nominal control variable 57.1, 57.2, 57.3, 57.4. It can be seen that the control elements 33 are not actuated immediately by the nominal control variables 57. Instead, these are first renormalized in a renormalization member 59, wherein the nominal control variable 57.1, 57.2, 57.3, 57.4 with the largest value is taken as the maximum allowable value for actuating the control elements 33, meaning that the control element 33 actuated with this largest nominal control variable is opened to the maximum possible degree. The other control variables 57 are scaled accordingly, so that their ratios to each other remain the same. This is possible especially when the control variables 33 have linear characteristics. The renormalization member 59 results in the renormalized nominal control variables 61.1, 61.2, 61.3, 61.4. If the method amounts to no more than the equalization of the evaporator flow channels 19, the control elements 33 would now be actuated by the renormalized nominal control values 61. As a result of the renormalization in the renormalization member 59, it would then be guaranteed that, at a given mass flow rate in the circuit 9, a minimum pressure drop would be present across the evaporator 7, because the evaporator flow channels 19—under the assumption that they have been equalized—have their maximum flow cross sections at the point where the control elements 33 are located.

To increase the stability of the system 5 even further, however, automatic control of the pressure drop is provided for the pressure drop across the evaporator 7. For this purpose, a characteristic diagram 63 is drawn up on the basis of a total mass flow rate 65, which is preferably determined by the total flow sensor 31, and some other operating parameter 67 of the system 5, wherein the characteristic diagram 63 comprises values for a minimum pressure drop or nominal pressure drop 69 to be specified as a function of the total mass flow rate 65 and the operating parameter 67. A temperature of the working medium downstream from the evaporator 7, especially at the evaporator outlet, namely, the previously determined average temperature or the temperature separately measured by means of the overall temperature sensor 37, and/or a pressure of the working medium downstream from the evaporator 7, especially at the evaporator outlet, and/or a superheating of the working medium downstream from the evaporator 7, especially at the evaporator outlet, is preferably used as the operating parameter 67. By way of the temperature, the pressure, and/or the superheating, a thermodynamic state of the working medium downstream of the evaporator 7, especially at the evaporator outlet, can be acquired, wherein the nominal pressure drop 69 to be set depends on this thermodynamic state.

In a differential member 71, an actual pressure drop 73, which is measured preferably by means of the pressure sensors 39, 41, and the nominal pressure drop 69 are compared with each other, from which a nominal-versus-actual deviation 75 is obtained. This is converted in a calculation member 77 under consideration of the system behavior of the system 5, especially under consideration of the characteristic curves of the control elements 33, into a global differential control variable 79. This is in turn converted by a controller 81 into a limit preset value 83, which ultimately is sent by a distribution member 85 to the differential members 87.1, 87.2, 87.3, 87.4. There the renormalized nominal control variables 61 are compared with the limit preset values 83, from which ultimately the control variables 89.1, 89.2, 89.3, 89.4 are obtained. With these resulting control variables 89, the control elements 33 are then finally actuated. The limit preset value 83 brings about a partial throttling of the control elements 33, so that, by means of the automatic pressure control, the pressure drop across the evaporator 7 can be increased by partially throttling the control elements 33 when, depending on the operating point, this is necessary to guarantee the stability of the system.

Thus it is found overall that, by means of the method, the control unit, the system, and the arrangement, the tendency to develop instabilities, especially the Ledinegg instability, can be considerably reduced, especially preferably by combining the equalization of the individual evaporator flow channels 19 with the automatic control of the pressure drop. As a result, the system 5 can be operated reliably. Ultimately this allows the construction of a large evaporator 7 out of smaller, possibly standardized evaporator blocks, which, under certain conditions, makes possible the economical use of several evaporator flow channels and which in some cases is more favorable than the development of a corresponding, large evaporator with a single flow channel. The method proposed here can also be scaled up to any number of evaporator flow channels.

While specific embodiments of the invention have been shown and described in detail to illustrate the inventive principles, it will be understood that the invention may be embodied otherwise without departing from such principles.

We claim:

1. A method for operating a system for a thermodynamic cycle with a multi-flow evaporator having at least two evaporator flow channels, the method comprising the steps of: making the evaporator flow channels to approximate each other with respect to at least one operating parameter of the individual evaporator flow channels, or controlling a pressure drop across the evaporator, wherein the evaporator flow channels are made to approximate each other by variation of control variables for control elements that are assigned to the individual evaporator flow channels, which control elements limit flow through the evaporator flow channels; and renormalizing the control variables so that the control element actuated by the control variable with a largest value is opened to a maximum extent.

2. The method according to claim 1, wherein the evaporator flow channels are made to approximate each other with respect to a flow rate of a working medium or with respect to a temperature of the working medium downstream from a vaporization area of the individual evaporator flow channels.

3. The method according to claim 1, including controlling the pressure drop across the evaporator by actuation of individual control elements assigned to the individual evaporator flow channels.

4. The method according to claim 3, wherein the control elements are valves.

5. The method according to claim 1, including varying the control variables by controlling the pressure drop.

6. The method according to claim 1, including calculating a desired flow rate for a working medium in the individual evaporator flow channels as a total mass flow rate of the system divided by a total number of evaporator flow channels.

7. The method according to claim 2, including calculating a desired temperature for the working medium downstream of the vaporization area as an average value of temperatures of the working medium downstream of the vaporization area of the individual evaporator flow channels or separately measuring the average temperature.

8. The method according to claim 1, including reading out a desired pressure drop from a characteristic diagram as a function of at least one operating parameter of the system.

9. The method according to claim 2, including operating the system with superheating of the working medium or in a wet steam region.

10. A control unit for a system for a thermodynamic cycle with a multi-flow evaporator having flow channels, wherein the control unit is constructed to make the evaporator flow channels approximate each other with respect to at least one operating parameter of the individual evaporator flow channels or wherein the control unit is constructed to control a pressure drop across the evaporator, wherein the evaporator flow channels are made to approximate each other by variation of control variables for control elements that are assigned to the individual evaporator flow channels, which control elements limit flow through the evaporator flow channels, and the control variables are renormalized so that the control element actuated by the control variable with a largest value is opened to a maximum extent.

11. A system for a thermodynamic cycle with a multi-flow evaporator comprising at least two evaporator flow channels, wherein each evaporator flow channel has its own control element arranged and set up to vary a flow cross section of the associated evaporator flow channel; and a control unit according to claim 10, the control unit being functionally connected to the control elements and configured to make the evaporator flow channels approximate each other with respect to at least one operating parameter of the individual evaporator flow channels or automatically to control a pressure drop across the evaporator through variation of control variables for the control elements.

* * * * *